US010748375B2

(12) United States Patent
Gulbrandsen

(10) Patent No.: US 10,748,375 B2
(45) Date of Patent: Aug. 18, 2020

(54) NETWORK BASED GAMING PLATFORM OR GAME APPLICATION AND METHOD FOR CARRYING OUT A GAMING CYCLE

(71) Applicant: SGX AS, Oslo (NO)

(72) Inventor: Magnus Skraastad Gulbrandsen, Oslo (NO)

(73) Assignee: SGX AS, Oslo (NO)

( * ) Notice: Subject to any disclaimer, the term of this patent is extended or adjusted under 35 U.S.C. 154(b) by 212 days.

(21) Appl. No.: 14/910,805

(22) PCT Filed: Aug. 16, 2014

(86) PCT No.: PCT/NO2014/050138

§ 371 (c)(1),
(2) Date: Feb. 8, 2016

(87) PCT Pub. No.: WO2015/020532

PCT Pub. Date: Feb. 12, 2015

(65) Prior Publication Data

US 2016/0203673 A1 Jul. 14, 2016

(30) Foreign Application Priority Data

Aug. 9, 2013 (NO) ..... 20131087

(51) Int. Cl.
*A63F 9/24* (2006.01)
*G07F 17/32* (2006.01)
*G06Q 50/34* (2012.01)

(52) U.S. Cl.
CPC ..... *G07F 17/3237* (2013.01); *G06Q 50/34* (2013.01); *G07F 17/3241* (2013.01);
(Continued)

(58) Field of Classification Search
CPC ..... G07F 17/3237; G07F 17/3241; G07F 17/3422; G07F 17/3269
(Continued)

(56) References Cited

U.S. PATENT DOCUMENTS 8,282,471 B1 * 10/2012 Korner ..... G07F 17/3288 463/25
8,414,387 B1 * 4/2013 Paradise ..... G07F 17/3276 463/25

(Continued)

FOREIGN PATENT DOCUMENTS

WO WO 2007/034458 A2 3/2007
WO WO 2009/032598 A1 3/2009

OTHER PUBLICATIONS

International Search Report and Written Opinion of the International Searching Authority for International Application No. PCT/NO2014/050138, dated May 12, 2014, 10 pages.

*Primary Examiner* — James S. McClellan
*Assistant Examiner* — Kevin M Carter
(74) *Attorney, Agent, or Firm* — Knobbe, Martens, Olson & Bear, LLP

(57) ABSTRACT

Systems and methods for a network based gaming platform or game application. A gaming cycle for a first user and one or more opponent players can be carried out on the network based gaming platform or game application. A database can store player data from the first user and the one or more opponent players, and the player data can be sorted and ranked. Players can be matched based on the player data, and a game type can be selected. A betting option and a stake can be chosen, and the first user can be debited for the chosen stake. The selected game type can be started, and game winnings can be transferred to a winner.

9 Claims, 1 Drawing Sheet

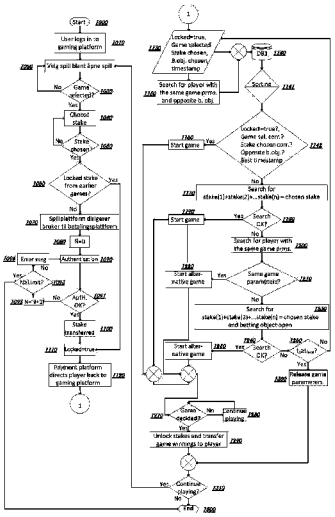

(52) U.S. Cl.
CPC ..... *G07F 17/3244* (2013.01); *G07F 17/3269* (2013.01); *G07F 17/3276* (2013.01); *G07F 17/3288* (2013.01)

(58) Field of Classification Search
USPC ..... 463/23, 25, 26, 30
See application file for complete search history.

(56) References Cited

U.S. PATENT DOCUMENTS 8,677,451 B1* 3/2014 Bhimaraju ..... H04L 63/083 726/2
2001/0019965 A1 9/2001 Ochi
2002/0002074 A1 1/2002 White et al.
2003/0096651 A1* 5/2003 Black ..... G06Q 40/04 463/42
2003/0177347 A1 9/2003 Schneier et al.
2007/0087832 A1* 4/2007 Abbott ..... G07F 17/32 463/42
2007/0218980 A1* 9/2007 Pachnis ..... A63F 13/12 463/25
2007/0265092 A1* 11/2007 Betteridge ..... G07F 17/32 463/42
2008/0076504 A1* 3/2008 Jenkins ..... G06Q 50/34 463/16
2009/0318219 A1* 12/2009 Koustas ..... G07F 17/32 463/23
2010/0029373 A1* 2/2010 Graham ..... G07F 17/32 463/25
2010/0029389 A1* 2/2010 Adiraju ..... G07F 17/32 463/43
2012/0028718 A1* 2/2012 Barclay ..... G07F 17/3218 463/42
2014/0011575 A1* 1/2014 Neubauer ..... G06Q 50/34 463/25
2014/0024435 A1* 1/2014 Scott ..... G07F 17/3223 463/25
2014/0045589 A1* 2/2014 Paradise ..... A63F 13/00 463/29
2014/0274311 A1* 9/2014 Aronowitz ..... G07F 17/3288 463/25

* cited by examiner

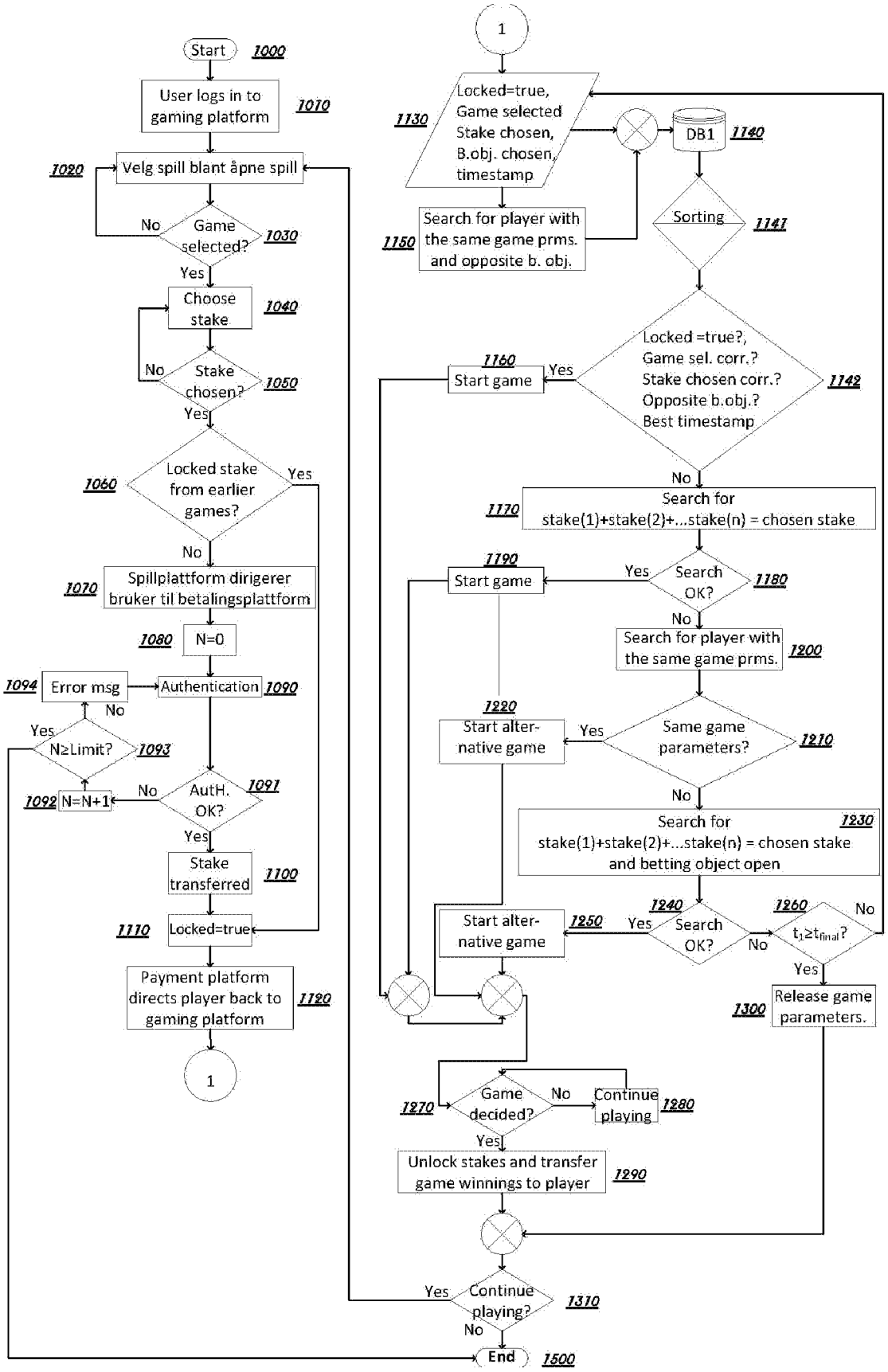
Start
1000
User logs in to gaming platform
1010
1020
Velg spill blant åpne spill
No
Game selected?
1030
Yes
Choose stake
1040
No
Stake chosen?
1050
Yes
1060
Locked stake from earlier games?
Yes
No
1070
Spillplattform dirigerer bruker til betalingsplattform
1080
N=0
1094
Error msg
Authentication
1090
No
Yes
N≥Limit?
1093
1092
N=N+1
No
AutH. OK?
1091
Yes
Stake transferred
1100
1110
Locked=true
Payment platform directs player back to gaming platform
1120
1
1
1130
Locked=true, Game selected Stake chosen, B.obj. chosen, timestamp
DB1
1140
1150
Search for player with the same game prms. and opposite b. obj.
Sorting
1141
1160
Start game
Yes
Locked =true?, Game sel. corr.? Stake chosen corr.? Opposite b.obj.? Best timestamp
1142
No
1170
Search for stake(1)+stake(2)+...stake(n) = chosen stake
1190
Start game
Yes
Search OK?
1180
No
Search for player with the same game prms.
1200
1220
Start alter-native game
Yes
Same game parameters?
1210
No
Search for stake(1)+stake(2)+...stake(n) = chosen stake and betting object open
1230
1240
Start alter-native game
1250
Yes
Search OK?
No
1260
$t_1 \geq t_{final}$?
No
Yes
1300
Release game parameters.
1270
Game decided?
No
Continue playing
1280
Yes
Unlock stakes and transfer game winnings to player
1290
Yes
Continue playing?
1310
No
End
1500

NETWORK BASED GAMING PLATFORM OR GAME APPLICATION AND METHOD FOR CARRYING OUT A GAMING CYCLE

CROSS REFERENCE TO RELATED APPLICATIONS

Any and all applications for which a foreign or domestic priority claim is identified in the Application Data Sheet as filed with the present application are hereby incorporated by reference in their entirety under 37 CFR 1.57.

TECHNICAL FIELD

The present invention relates to gaming platforms and game applications, and more particularly the invention relates to a networked computer gaming platform or game application configured for carrying out a gaming cycle for a first user and one or more opponent players on the networked computer gaming platform or game application. The invention also comprises a method of carrying out a gaming cycle for a first user and one or more opponent players on a networked gaming platform or a game application on a computer.

BACKGROUND ART

Games of chance have existed throughout human history and the particular game roulette has existed since around the 18th century, and today there are also web-based casinos that offer this game.

A disadvantage of games of chance is that the players have to share their betting stakes with a game bank. Besides the obvious consequence that less of the stakes are returned to the players, this also means that the game banks must protect themselves against being emptied, and therefore a number of restrictions are imposed on games of chance in which a game bank administers stakes and payouts.

Hence, game banks protect themselves against system players and groups of system players so that such players will not be able to empty the game bank. This is achieved in that betting stakes are subject to an upper limit, and/or in that players are not allowed to bet on the same betting option an unlimited number of times.

Casinos/game banks protect themselves against tactical play and players following special game systems in that:

1. They monitor the playing pattern of the players and exclude people if they try to follow a doubling principle for more than a given number of times.
2. Their most important means of protecting themselves, however, is to impose a maximum limit for bets, which prevents the players from following the doubling principle a sufficient number of times for the probability to become sufficiently high and also precludes the betting of significant amounts of money.

As mentioned, game banks protect themselves against system play of the Martingale type and other types. It is a desire within the gaming community to have a platform in which players are allowed operate freely with respect to the use of their own playing systems.

SUMMARY OF THE INVENTION

It is an object of the present invention to provide gaming platforms in which players are not subject to the restrictions found in the games available today.

According to the invention there is provided a networked computer gaming platform or game application configured for carrying out a gaming cycle for a first user and one or more opponent players on the networked computer gaming platform or game application, further comprising at least:

a) a payment platform comprising an authentication platform configured for the secure authentication of the first user and one or more opponent players,
b) a first database configured for storing player data from the first user and the one or more opponent players, the user data comprising:
   i. a selected game(i) for the first user and the one or more opponent players,
   ii. a chosen stake(i) for the first user and the one or more opponent players,
   iii. if the chosen stake for the first user and the one or more opponent players is marked as locked from the payment platform, then locked(i)=true,
   iv. a chosen betting option(i) for the first user and the one or more opponent players,
   v. a timestamp indicating the time at which the first user and the one or more opponent players selected a game, timestamp(i), with a timestamp that is earlier in time than a second timestamp being considered as smaller,
c) a sorting module associated with the first database, the sorting module being configured for sorting and ranking player data, and
d) a selection module configured for matching players based on player data.

Also provided is a method for carrying out a gaming cycle for a first user and one or more opponent players on a networked gaming platform or a game application on a computer, comprising the steps of:

a) logging in to the networked gaming platform or starting the game application on the computer,
b) selecting a game type through the game application or gaming platform and a betting option,
c) choosing a stake,
d) directing, by the gaming platform or game application, the first user to a secure payment service unless a value corresponding to the stake is marked as locked in a first database; otherwise, if a value corresponding to the stake is locked, the game application or gaming platform proceeds to step i,
e) authenticating, by the first user, for the payment service,
f) debiting the first user for the stake by the payment platform,
g) directing the first user back to the gaming platform or game application,
h) searching, by the gaming platform or game application, for opponent players in a first database,
i) starting the game selected from the game application or gaming platform, and
j) transferring the game winnings to the winner.

According to a first aspect thereof, the method further comprises the steps of:

verifying by the gaming platform or game application whether a game has been selected and if a game has not been selected, returning to step b in order to invite the first user to select a game. In step b, the gaming platform or game application may access the first database to locate available games.

In a further aspect, the authentication step e by the first user comprises setting a counter N to 0 in a program on the payment platform before the first user tries to authenticate himself, then, if authentication is successful, the payment platform proceeds to step f, otherwise, if authentication is not successful, the following steps are performed:

incrementing the counter N=N+1, if N has reached an upper limit, providing an error message informing that authorization will not be given and directing the first user back to the gaming platform or game application, after which the execution of the game application or gaming platform is terminated, otherwise, if N has not reached an upper limit, providing an error message to the first user and allowing the first user to retry authentication.

In a further aspect, step h comprises:

i. entering game parameters into a table and marking the stake as locked (1130) and transferring the table to the first database, ii. sorting players in the first database, in which players that have selected the same game, same stake, opposite betting option are sorted by time iii. searching for opponent players having the same game parameters with an opposite betting option in the first database, and iv. if a player matches the search of step iii, starting the game.

Step h may further comprise the steps of:

v. if no players in step iv matches the search, proceeding with step vi, vi. searching for opponent players having selected the same game and an opposite betting option, where the sum of the stakes of sought players corresponds to the stake of the first user, the search being performed starting with players having the smallest time in the first database, and vii. if the search for additional players results in a match, starting the game.

Step h may further comprise the steps of:

viii. proceeding with step ix if no players in step vii i matches the search, ix. searching for opponent players having selected the same game and the same game parameters, the search being carried out starting with players having the smallest time in the first database, x. starting an alternative game if the search for additional players results in a match.

Step h may further comprise the steps of:

xi. proceeding with step xii if no players in step x i matches the search, xii. searching for opponent players having selected the same game and an indefinite betting option, where the sum of the stakes for sought players corresponds to the stake of the first user, the search being performed starting with players having the smallest time in the first database, and xiii. starting an alternative game if the search for additional players results in a match.

The alternative game may be a game chosen by the gaming platform or game application.

Step h may further comprise the steps of:

xiv. proceeding with step i if no players in step xiii i matches the search and the time $t_1$ is smaller than a predetermined time limit $t_{final}$.

The game application or gaming platform may release game parameters if $t_1 > t_{final}$ and the gaming platform or game application then allows the first user to proceed to select a game.

Step h may further comprise the steps of:

locking in stakes and transferring the game winnings to the winner(s) if steps iv, vii, x or xiii resulted in the playing of a game. Following these steps, the game application or gaming platform may release the game parameters and the gaming platform or game application allows the first user to proceed to select a game.

According to the invention, also provided is an alternative method of carrying out a gaming cycle for a first user and one or more opponent players on a networked gaming platform or a game application on a computer, comprising the steps of:

a) logging in to the networked gaming platform or starting the game application on the computer, b) selecting a game type by way of the game application or gaming platform, c) presenting, by the gaming platform or game application, a list of players having selected the same game type, d) choosing, by the first user, one or more opponent players from the list of players having chosen the same game type, choosing stake, by the first user, f) directing, by the gaming platform or game application, the first user to a secure payment service unless a value corresponding to the stake is marked as locked in a first database; otherwise, if a value corresponding to the stake is locked, the game application or gaming platform proceeds to step i, g) authenticating, by the first user, for the payment service, h) debiting the first user for the stake by the payment platform, i) directing the first user back to the gaming platform or game application, j) starting the selected game from the game application or gaming platform, and transferring the game winnings to the winner.

Step e may further comprise that the first user chooses a betting option. It should be noted that the gaming platform or game application may carry out a game with no betting option being chosen, in which case the gaming platform or game application will assign the players a randomized betting option. The betting option may then be some betting option typical for the game, such as the colour black or red for roulette, in which case there may be more than one winner if several players participate, or alternatively the gaming platform or game application could choose a hidden betting option, hence a randomized value that is unique for each player, with only one outcome being a winning outcome.

Further features and advantages will be apparent from the accompanying claims.

BRIEF DESCRIPTION OF THE DRAWINGS

To facilitate the understanding of the invention, reference is made to FIG. 1, in which FIG. 1 shows a flow chart of a game application or gaming platform according to an embodiment of the present invention.

DETAILED DESCRIPTION OF THE INVENTION

It is an object to provide a network or web based system with which users of the system, by way of computers, smart phones, tablets, or the like, may access a gaming platform in order to take part in gaming activities, the gaming activities being independent of a central bank taking a profit based on that the bank has a probabilistic advantage. By the term computer shall be understood any device comprising a microprocessor, user interface, Internet access means, display, and memory, examples of which may be as indicated above.

By betting option shall be understood the choice on which a player chooses to place his bet for a selected game. Typically, in a casino game, a betting option may be a colour, an even number, an odd number, groups of numbers or a particular number, while in "coin games" the counterpart will be tails or heads, in card-playing the counterpart will be the composition of hands of cards, colour, suit, spades, hearts, clubs, or diamonds, and in odds games, for example, the counterpart will be certain results/outcomes on which bets are made.

In the description that follows, a platform, gaming platform, game application, or gaming system shall be understood as the interface through which the players, in accordance with the present invention, carry out their gaming activity, which interface may be a purely web-based solution in which the interface is provided via a gaming portal or may be an interface provided through an application stored locally at each individual player, in which case the application can initiate communication with other players possessing the same application and/or with registered players having access to a gaming portal as indicated above.

If the users are not playing against a casino monitoring their playing or imposing an upper stake limit, the users will be able use the Martingale system, for example.

In accordance with the invention, there is further provided an autonomous multi-user gaming system in which the users can carry out transactions and play against one or more other users, hence a "one-against-many", or "one-against-one", or "many-against-many" system. If a first user wishes to play with a particular stake and no single user is found that is willing to play against him by calling the bet, then the gaming platform or game application will invite several users which combine to match the stake of the first player. In this manner users can participate in the bet with only a small stake, and the first user, on the other hand, can play with a big stake. Said platform is provided to implement such a solution.

Different users may open a web site and/or an application to select and bet money on either red/black or heads/tails or another "betting option". They are not playing against a casino, but instead a first user or first group of users bets against a second user or second group of users somewhere in the world which bets a corresponding amount on an opposite betting option of the one on which the first user or first group bets.

In this manner the players are winning from each other. As long as one has access to capital, one may follow his own game systems such as the Martingale system or other systems with no stake limit imposed. If one wishes to place a bet that is so huge that nobody wants to bet against, then one may wait until someone is willing to bet against, or one may let the gaming platform or game application actively search for/invite individual players to bet against or find a plurality of players betting a smaller amount on the opposite betting option which combine to call your bet.

The user interface also will allow a first player to search for particular players and establish a game against the sought player or players. The game application or gaming platform allows a player to search for registered player names, and if the sought player(s) is/are active, then the first player can invite to a game. The searching functionality and transfer of stakes and winnings are described in more detail in the sections relating to the first and second embodiments of the present invention.

According to the invention, a networked gaming platform or a game application on a computer is provided, which game application is provided with a network interface for communicating with other game applications and with networked payment services. The platform and application comprises at least a «system and method for competition, ranking, and distribution of valuables in an electronic network»:

1. access to an electronic network (e.g. the Internet)

2. access to an application, a URL/web site/platform or the like.

3. Login with an associated payment system for the electronic transfer of money.

4. A list of value levels with two different «betting options» (i.e. two clearly differentiated alternatives on which bets can be placed), and relevant value distributions currently in progress.

5(a). Possibility of paying in on a desired value level associated with a desired betting option (play on an existing competition opportunity)

5(b). Possibility of entering a new stake size (value level) as desired.

6(a). After a value level and betting option have been chosen and the stake has been paid, then the system initiate a search for someone that bets the same amount on the opposite betting option. (E.g.: 20 dollars on EITHER red or black/head or tails/black or white, or the like)—the outcome is either outcome 1 or outcome 2, but the virtual reality shown on the display screens of two persons betting against each other may appear as «red vs. red» or tails vs. tails, but only red(a) or tails(a) wins, not red(b) or tails(b)).

6(b).Alternatively, or if nobody bets against, you may have the system locate several users which combine to match your bet and play against you. For this scenario an algorithm must be added that locates the nearest available, oppositely betting users. If not a sufficient number of available users in some combinable form is found within a certain time limit, then the search is discontinued and the invited users are released and may play against other players that bet the same amount as themselves and the system performs a new search for one or more players that, combined or individually, call the bet. (Time, size, number)

7. When a player (or a group of players) bets the same amount on an outcome opposite to your choice and both (everybody) has paid in and «locked their bets» to «the total value» (consisting of 2×the stake on the highest stake betting option, in other words 2×the value level of the player with the highest stake), then the randomizing system deciding whether it is outcome 1 or outcome 2 that wins «the total value» is activated. If one has chosen outcome 2, then one receives «the total value» if the result was outcome 2 and, in this case, if one has chosen outcome 1 then one will not receive any of «the total value» because it has already been distributed to the one betting on outcome 2. If outcome 2 (which in this example wins «the total value») is a composition of several value levels which combine to match the value level of the one that has chosen outcome 1, then «the total value» is distributed to those betting on outcome 2 according to the stakes of the individual players so that such stakes are doubled.

8. A percentage of the «total value» may be distributed to a third party.

The concept of «casting lots» has existed since the beginning of human history (i.e. betting with approximately 50% chance of winning) and is not new.

The gaming platform or game application according to the present invention with Internet interactivity makes it possible to solve practical difficulties to enable the carrying out of such games as described. The gaming system according to the invention allows individual players to play against several other players which together match the stake of the individual player. Hence, one may not only bet «vertically» against one user, but also «horizontally » against several users. In this manner one may also contribute to that the largest winnings, and the corresponding losses, are divided among several players.

Hence, the invention makes it possible to establish a bet or game in association with a randomizing system. The bet/play is integrated in all necessary parts of the gaming system including in a database with an overview over all games, thereby making the bet searchable for opponent players.

The gaming system according to an embodiment of the invention may team up several users against a single player according to a particular algorithm. The gaming system, i.e. the gaming platform or game application, may gather several available players that together have indicated that they are willing to match the stake of the first player. In the case that more than a given time period is spent on gathering players into a group to call another players bet, then the game may be aborted so that those reserved into a group do not have to wait for longer than the given time for the game to start.

A First Embodiment of the Invention

The invention will now be described in more detail with reference to FIG. 1. Users of the invention, according to the first embodiment of the invention, may register on a web site to access the networked gaming platform according to the present invention. Alternatively, users of the invention may acquire a locally storable game application giving access via a network to carry out gaming activity in accordance with the present invention. The game application provides the same network game alternatives as indicated for the gaming platform in the scenario below directed to the first embodiment. Thus, in the following, it should be understood that the term gaming platform may also refer to a game application interacting with a server/gaming platform via a network.

A typical scenario for carrying out a gaming cycle for a first player and one or more opponent players may comprise one or more of the following steps.

The first user logs on to the gaming platform 1010 by accessing a web site for accessing the gaming platform.

With this, the first user, from the gaming platform, is allowed to select a game in which he wants to take part, 1020. The options are retrieved from open games, i.e. that the gaming platform first offers games for which an opponent player is needed. The first user may also initiate a game for which currently no other players are available. Ongoing games are not open for access.

Having been presented for the gaming options available, the first user selects a game from the gateway of the gaming platform, 1020. If the first user does not select a game within a certain time limit, the gaming platform will update the gaming options and ask the first user to choose among available games, 1030.

The game selected has a "value", which is referred to as the "selected game" in the following, whereas, of course, the "value" for real games will reflect the selected game. The game selected is associated with the first user/player so that game value of the first user will be the selected game ($i_1$), where $i_1$ represents the first user. Other players will, of course, be assigned another value, such as selected game($i_2$), selected game($i_3$), etc., for example.

Thus far, the first user has "reserved" a game of a chosen type in a game database DB1. This reservation will expire after a certain time, so the first user needs to complete his steps in order to start a game before said time period has expired. The first user is assigned a time value, a timestamp ($i_1$), which time value indicates the time at which the first user chose his game, is used for determining whether timeout shall be initiated by the gaming platform, and is used for ranking players in the first database DB1.

Having selected a game, the first player will be asked to enter a stake, 1040, i.e. the amount or value with which he wants to play, and the chosen stake will also be assigned a "value", namely "chosen stake($i_1$)". If the first user does not enter a stake for the selected game within a given time period, the gaming platform will repeat the invitation to enter a stake, 1050. If the first user enters his stake within the time limit therefore, then the gaming platform will check if the first player has a locked/reserved stake already existing in the system from earlier games or from winnings that have not been withdrawn from the earlier games, 1060. Herein, a locked stake also includes any prepaid game credits, or is a pure credit or given as a start-up bonus or another type of bonus. If he has a locked stake that is larger than the one with which he has chosen to play, then the arrears will remain locked until the first user wishes to have them paid out/transferred to himself. If the stake is larger than the already existing locked stake, then he will be informed that the remaining amount must be paid. After this step, which in many cases proceeds unnoticed by the user as he does not have any already locked stake and therefore does not need to be informed that only a partial payment or no payment at all shall be entered, in such cases, the first user is directed to a payment platform, 1070. The gaming platform registers that the first user has accessed the platform and sets a counter to 0, 1080 (N=0). The counter is used in a subsequent authentication step in order to limit the ability of the first user to repeat his authentication attempts indefinitely. Also, a timer based on timestamp($i_1$) combined with the time spent by the first user to authenticate himself is started, and if one of said time limits expires, then the first user will be returned to the gaming platform and has to start from the beginning, 1020, by selecting a game. If the user enters incorrect user identification and/or wrong pin code (verification code) he will be given a new chance while at the same time the counter N is incremented, 1092. The counter associated with the authentication time as such is stopped as soon as the first user has tried to authenticate, whereas timestamp($i_1$) runs the entire time. The first user will be allowed several chances to authenticate himself as long as N<limit, where limit is the number of times the first user has tried to authenticate himself for the payment platform. In case of the normal situation, i.e. that the first user has authenticated himself correctly without expiring N or any of the timers, then he will receive a confirmation that the authentication is successful, 1091, and the stake will be transferred to an interim account, 1100, on which the stake is locked, and locked($i_1$) is set to "true", 1110.

Following step 1110, the payment platform will direct the player back to the gaming platform. In this regard, it should be understood that the gaming platform and payment platform may be represented by software running on a same computer/server and that the distinction hence is not a physical one. In cases in which the player has a locked stake from earlier games, such directing back to the gaming platform will not be necessary. Also, the user interface for the user does not need to display movements between the game and payment platforms.

In the following step, 1130, all game parameters including the stake are transferred to a first database (DB1), which transferred parameters include a time value, namely timestamp($i_1$).

The gaming platform will then search for players having the same game parameters but with the opposite betting option 1150 in the first database DB1. The search is possible because, in the first database, players 1141 are continuously sorted by game parameters, including the time value.

In the next step it is checked whether an opponent player has been found that meets all criteria, i.e. has the same game parameters except for the betting option, which is opposite, and the time value which will necessarily be different, 1142. It should be noted that, according to an alternative, players may play with an unspecified betting option, which betting option will then be decided by the gaming platform. Sorting of players having the same game parameters will be carried out by the size of the time value, in accordance with a prioritization scheme in which earliest in time gives the best rights, i.e. first in first out. If the result of inquiry 1142 is yes and the platform is able to locate an opponent player, a game can be started, 1160.

If no players are found in the first database DB1 meeting the criteria of inquiry 1142, a new search is performed in which opponent players are sought which have selected the same game, an opposite betting option, and necessarily a different time value, and which when combined have a locked stake matching the stake of the first player (bet($i_1$)), 1170. If the search 1180 for players with a combined stake corresponding to the one of the first player is successful, then a new game is started, 1190, otherwise, if the search 1180 is not successful, then the platform proceeds with another search 1200. In this case players are sough which have selected the same game type, the same betting option (same game parameters). According to an alternative, an additional search, not shown in the drawing, is performed if players having the same game parameters except from the time value are found, which search may be performed similarly as step 1170. Following the search for players having the same game parameters 1200 a test 1210 is performed to see whether any such players have been found, and in that case an alternative game is started, 1220. This alternative game is optional and may consist in that players having the same game parameters are arranged to play against each other despite the fact that they have chosen the same betting option. The outcome, i.e. winner, may then be generated randomly by a random number generator, wherein the input values to this random number generator may be, for example, the time value of the first player or time values of all parties involved in the play of the first user. This game and the manner in which it is implemented will not be discussed in detail herein, as a person skilled in the art may devise his own variant games. It should be noted that the betting option of the opponent players chosen do not need to be identical, but may also be unspecified.

If the result of the inquiry in 1210 is no because no individual player exist that has entered the same betting amount, then a search step 1230 is performed for players which the combined stakes are sufficient. The search is followed by an inquiry 1240, and if the result of this inquiry is yes then an alternative game 1250 will be initialized. Conversely, if result of the inquiry is no, a new inquiry will be made, 1260, which inquiry establishes whether sorting steps 1141-1260 have lasted longer than a given time $t_{final}$, and if not, step 1130 and the following steps 1140 through 1240 are repeated. Steps 1141 to 1260 are performed by a software module referred to as a sorting module. If $t_1$, i.e. steps 1141-1260, have progressed for longer than the given time $t_{final}$, then a following step 1300 will be initiated in which game parameters are released.

As mentioned, if the conditions for the alternative game are met in step 1240, an alternative game will be initiated in step 1250.

Subsequent to or continuously during the play of the games of steps 1160, 1190, 1220 or 1250, a check 1270 will establish whether the outcome of the game has been decided, and if not, the game continues, 1280. If the game has been decided, this step is followed by a step 1290 in which stakes are unlocked and the game winnings can be transferred to the winner(s). The actual transfer of the winnings will be performed subsequent to step 1310, in which the player may choose play a new game.

Following step 1290, the players are asked if they wish to continue playing, 1310, in which case players having outstanding winnings or credits will be offered to use these as a stake in the new game, after which step 1020 will be initiated. Players that don't wish to continue playing will initiate a logout procedure in step 1500.

A Second Embodiment of the Invention

A second embodiment of the invention will now be described in more detail with reference to FIG. 1. Users of the invention, according to the second embodiment of the invention, must register themselves on a web site to obtain access the networked gaming platform according to the present invention, or alternatively the registering may be performed automatically through a game application stored locally at the computers of the users of the invention. Players in possession of the game application may already have authenticated themselves and been verified in prior steps during the acquisition of the game application. If such authentication has already taken place, then authentication may be performed in that hardware parameters such as a MAC (Media Access Control) address, IMEI address, or other hardware-identifying parameters are transmitted to a first server so that the login step 1010 is performed automatically. Authentication may be supplemented by a further authentication element such as a PIN code or a confirmation from another device than the one on which the game application is located, which is them sent to the first server.

A typical scenario for carrying out a gaming cycle for a first player and one or more opponent players may include one or more of the steps below.

The first user logs in to the gaming platform 1010 by accessing a web site for accessing the gaming platform, or alternatively by starting a game application for login.

With this, the first user is given access from the gaming platform or via the game application to select a game in which he wants to take part, 1020. The available options are retrieved based on games that are open.

Having been presented for the gaming options and opponent players available, the first user selects a game and one or more opponent players from the portal of the gaming platform, 1020. If the first user does not select a game within a certain time limit, the gaming platform will update the gaming options and the list of available opponent players and ask the first user to choose among the available games.

The game selected has a "value", which is referred to as the "selected game" in the following, whereas, of course, the "value" for a real game will reflect the selected game. The game selected is associated with the first user/player so that game value for the first user will be the selected game($i_1$), where $i_1$ represents the first user. Other players will, of course, be assigned another value, such as selected game($i_2$), selected game($i_3$), and so on, for example.

Thus far, the first user has "reserved" a game of a chosen type in a game database DB1. This reservation will expire after a certain time, so that the first user needs to complete his actions to start a game before said time period has expired. The first user is assigned a time value, a timestamp ($i_1$) , which time value indicates the time at which the first user chose his game, is used for determining whether timeout shall be initiated by the gaming platform, and is used for ranking players in the first database DB1.

Having selected a game, the first player will be asked to enter a stake, 1040, i.e. the amount or value with which he wants to play, and herein the chosen stake will also be assigned a "value", namely "chosen bet($i_1$)". If the first user does not enter a stake for the selected game within a given time period, the gaming platform will repeat the invitation to enter a stake, 1050. If the first user enters his stake within the time limit therefore, then the gaming platform will check if the first player has a locked/reserved stake already existing in the system from earlier games or from winnings that have not been collected from the earlier games, 1060. Herein, a locked stake also includes any prepaid game credits, or is a pure credit or given as a start-up bonus or another type of bonus. If he has a locked stake that is larger than the one with which he has chosen to play, the arrears will remain locked until the first user wishes to have them paid out/transferred to himself. If the stake is larger than the already existing locked stake, then he will be informed that the remaining amount must be paid.

Following this step, the first user will be given the possibility to choose an opponent player from a list. The candidate opponent players presented have selected the same game, and the same betting option. The step of choosing opponent players manually is not shown in FIG. 1, but typically this step will be performed between steps 1050 and 1060 or directly after step 1060. In the latter case, the jump from 1060 to 1110 will take place before opponent players are chosen if the conditions for the jump is met.

A special case is that the first user is allowed to choose opponent players independently of the betting option, i.e. a game is created in which the players bet on the same betting option. If a game is established between players betting on the same betting option, then a winner will be decided from other criteria than the betting option. Outcomes and distribution of winnings can be achieved in accordance with the same pattern as in the alternative game according to the first embodiment. The first user may choose to receive the list of active games with no chosen betting options being shown, or alternatively, as indicated above, he may search for particular players with the chosen betting option or game parameters being taken into account. In cases in which playing is performed independently of betting option, the steps of choosing game 1020, 1030 will not include any choice of betting option.

Steps 1070 through 1120 relating to payment will not differ from those set out for the first embodiment.

In step 1130, all game parameters including the betting stake will be transferred to a first database (DB1), which transferred parameters includes a time value, namely timestamp($i_1$).

The sorting and search functions indicated in steps 1141 through 1270 will not be needed when an opponent player has been chosen by the first player. Steps 1270, 1280, 1290, 1310, and 1500 are performed as in the first embodiment. Step 1300 is not relevant for the second embodiment, as the first player himself has chosen an opponent player having the same betting stake and the same selected game.

The second embodiment differs from the first one mainly in that the first player makes the choice of opponent player(s) by himself. It should be understood that the first player may continue after step 1310 and then choose the second or the first embodiment, i.e. allow the gaming platform to pick opponent player(s) or choose the opponent player by himself. It should also be understood that the first embodiment may include authentication/login functionality as set out for the second embodiment.

A Third Embodiment of the Invention

According to a further aspect of the invention, a system is provided in which players are allowed to bet against each other on various events, and thereby establish and publish a web-based bet on which anyone can gamble. The payout of winnings is determined by which player(s) had betted on the occurrence of the actual outcome of the event. The payout mechanism is associated with a relevant result site or another electronically detectable event. The event subject to betting could be anything found in real life (with a digital counterpart) or something that only exist digitally. Examples may be football, chess and boxing matches, Parliamentary elections, "Warcraft" games, whether or not YOU arrive at a warehouse before 4.00 p.m. on March 14, whether the hero defeat the bad guy in a movie soon to be released or whether your grandchild will win a fencing match or achieves grade A on an exam. The concept is about being able to bet money against someone else on whether or not different events will occur. The bet may be designed so that one bets against each other on an event with 2 outcomes, 2 players bet against each other on whether or not one of several outcomes will occur, or so that one bets on one of several possible outcomes in a bet against several others, and that the winner takes it all (e.g. the result of spinning a random wheel of fortune, or whether nominee x, y, or z wins an Oscar.) An example would be that several players bet on that they will themselves have scored the most points when the game is over, and the winner receives the combined stakes of the players. Alternatively, the player(s) of the one team play(s) against the player(s) of the second team. At the same time, anyone may enter this bet and play against someone else on their favourite team, with the online game being streamed on Youtube, for example.

In this case, as opposed to with a bookmaker that needs to make sure the «bookmaker's house» always has a probabilistic advantage, people will get the greatest odds without the house losing in that the players play against each other. An application or web site able to «associate with» other web sites and electronic information made available by detectable events or events that is created if they don't already exist. People may then make their bets available for the entire world by associating them with results that are/become digitally available. The invention according to the second aspect gives the users of the invention numerous advantages as compared to those obtained in the case where a bookmaker or central bank constitutes an intermediary:

1. Better odds (2 or more), no stake limit, unlimited number of bets (one player against several players if nobody dares match your stake, as indicated in an embodiment of the present invention)
2. Simplifying, and making available for the entire world, the conventional bet. One may bet against someone on the other side of the world (e.g.: bet on the outcome of a computer/online game, streamed events, everyday bets between friends and associates; games, card-playing, running competitions, arm-wrestling)

3. Creating attention and involvement around events otherwise unimportant for others (a football game of your son)
4. In the case of several possible outcomes, one may bet against several players (higher risk of loss but greater payoff)
5. Global publishing and posting of bets (e.g. with live streaming)
6. Betting on own achievements, so that one are able to control whether one wins (incentivize the desired conduct, bet pro or against whether an entrepreneur company will do well)
7. Marketing (bet on the success of an advertisement campaign and thereby create incentive to buy, or attract sponsors to events for which a match is streamed)
8. May also be associated with a purely random wheel of fortune.
9. Associating lots of information or live streaming with a bet. One may gamble on any arena and add an extra "financial dimension" and excitement to any event The invention, according to its second aspect, comprises a method and system for a money transfer system associated with outcomes of "electronically detectable events":

The element of "uploading"/"associating" electronic events that may control a cash flow, e.g. a result site of an online game, or a sports results site, is important.

1. an electronic network (e.g. the Internet)
2. an application, URL/web site/platform or the like.
3. Login in which a payment system is associated for the electronic transfer of money, and identification.
4. List of categories, bets, and id numbers.
5. Possibility to pay in on a desired value level associated with the outcome of an event.
6. Possibility to enter a new bet by uploading a new event from an electronic source somewhere.

The bet may be defined in several different manners provided that there exists an electronic equivalent to the event and that there are one or more possible outcomes (e.g. one may bet on that the soccer club Rosenborg wins and someone may bet against, and if there are further alternative outcomes (draw), then the bet can either be defined so that the stake money is returned to the respective players or else goes to the player that betted against victory to Rosenborg, or else it can be arranged so that one plays against 2 others betting on loss and draw, respectively. Alternatively, it can be defined that several later players enter stakes of different size for the bet, or that one bets against everybody up to a certain stake size or a certain number of players, and one may select category, enter date and time for the decision.) The result site, or platform, that shows the outcome on which one bets is loaded, and this "source" is associated with the bet and makes the payout of the winnings dependent on the change in the source that will take place when the outcome is decided.

7. After a bet has been chosen and the stake has been paid, then the system searches for someone that bets the corresponding amount on the opposite or another outcome (e.g. 20 dollars on that Rosenborg wins against Valerenga and someone bets 20 dollars against)
8. Alternatively, or if nobody bets against, one may have the system locate several players that together match your bet and play against you (as discussed in another embodiment of the invention, cf. FIG. 1.
9. When a player (or a group of players) bets the same amount on the opposite outcome of you and both (everybody) have paid and «locked the stakes» to the stake pool, then the transfer is irreversible and payout is made according to the outcome shown by the electronic event in accordance with the specifications of the bet.

Alternatively, several outcomes may be bet on by several players playing with the same stake, in which case the one that has bet on the outcome that actually occurs receives all the betting stakes.

A percentage of the winnings may be distributed to a third party.

What is claimed:

1. Network computer gaming platform or game application configured for enabling a user to design games and carry out a gaming cycle based on one or more potential random outcomes or one or more outcomes that can be detected on a network, the gaming cycle being for a first user and one or more opponent players on the networked computer gaming platform or game application, and the network computer gaming platform or game application further comprising, at least:

a) a payment platform comprising an authentication platform configured for the secure authentication of the first user and one or more opponent players,
b) a first database configured for storing player data from the first user and the one or more opponent players, the user data comprising:
   i. a designed or selected game for the first user and the one or more opponent players,
   ii. a chosen stake for the first user and the one or more opponent players,
   iii. if the chosen stake for the first user and the one or more opponent players is marked as locked from the payment platform, then locked=true,
   iv. a chosen betting option for the first user and the one or more opponent players,
   v. a timestamp indicating a time at which the first user and the one or more opponent players selected the game, timestamp, with a timestamp that is earlier in time than a second timestamp being considered as smaller,
c) a sorting module associated with the first database, the sorting module being configured for sorting and ranking player data,
d) a selection module configured for matching players based on player data, wherein matching comprises:
   i. entering game parameters into a table and marking the stake as locked, and transferring the table to the first database,
   ii. sorting, by the sorting module, players in the first database, with players having chosen the same game, same stake, opposite betting option being sorted by time,
   iii. searching for an opponent player having same game parameters but an opposite betting option in the first database, and wherein the method further comprises:
   iv. if a player matches the search of step iii, start a game,
   v. if no player in step iv matches the search, proceeding with step vi,
   vi. searching for opponent players having selected the same game and an opposite betting option, where the sum of the stakes of the sought players corresponds to the stake of the first user, the search being performed starting with players having a smallest time in the first database, and vii. if the search for multiple players results in a match, starting the game, and e) an interface for communication with electronically detectable events on the network.

2. A method for enabling a user to design games and carry out a gaming cycle based on one or more potential random outcomes or one or more outcomes that can be detected on a network, the gaming cycle being for a first user and one or more opponent players on a networked computer gaming platform or game application, and the method comprising the steps of:

a) logging in to the networked gaming platform or starting the computer game application, b) selecting or designing a game type via the game application or gaming platform and choosing a betting option, c) choosing a stake, d) directing, by the gaming platform or game application, the first user to a secure payment service unless a value corresponding to the stake is marked as locked in a first database, otherwise, if a value corresponding to the stake has been locked, the game application or gaming platform proceeds to step i, e) authenticating, by the first user, for the payment service, f) debiting the first user for the stake by the payment platform, g) directing the first user back to the gaming platform or game application, h) searching, by the gaming platform or game application, for opponent players in the first database, wherein searching for opponent players comprises:

i. entering game parameters into a table and marking the stake as locked, and transferring the table to the first database, ii. sorting, by the gaming platform or game application, players in the first database, with players having chosen the same game, same stake, opposite betting option being sorted by time, iii. searching for an opponent player having same game parameters but an opposite betting option in the first database, and wherein the method further comprises:

iv. if a player matches the search of step iii, start a game, v. if no player in step iv matches the search, proceeding with step vi, vi. searching, by the gaming platform or game application, for opponent players having selected the same game and an opposite betting option, where the sum of the stakes of the sought players corresponds to the stake of the first user, the search being performed starting with players having a smallest time in the first database, and vii. if the search for multiple players results in a match, starting the game, i) starting the selected or designed game from the game application or gaming platform, j) transferring the game winnings to a winner, and k) communicating, via an interface of the game platform or game application, with electronically detectable events on the network.

3. The method of claim 2, further comprising the steps of:

verifying, by the gaming platform or game application, whether or not a game has been chosen and if a game has not been chosen, return to step b to invite the first user to select a game.

4. The method of claim 2, wherein the gaming platform or game application, in step b, accesses the first database to find available games.

5. The method of claim 2, wherein step e of authenticating the first user further comprises setting a counter N equal to 0 in a program on the payment platform before the first user tries to authenticate himself; if authentication is approved, then the payment platform proceeds to step f, otherwise, if authentication is not approved, then the following steps are carried out:

incrementing the counter N=N+1, if N has reached an upper limit, providing an error message notifying that authentication will not be given and directing the first user back to the gaming platform or game application, after which the execution of the game application or gaming platform is terminated, otherwise, if N has not reached an upper limit, sending an error message to the first user and allowing the first user to retry authentication.

6. The method of claim 2, further comprising the steps of:

viii. proceeding with step ix if no player in step vii i matches the search, ix. searching for opponent players having selected the same game and the same game parameters, the search being performed starting with players having the smallest time in the first database, x. starting an alternative game if the search for several players results in a match.

7. The method of claim 6, further comprising the steps of:

xi. proceeding with step xii if no players in step x i matches the search, xii. searching for opponent players having selected the same game and an unspecified betting option, where the sum of the stakes of sought players corresponds to the stake of the first user, with the search being performed starting with players having the smallest time in the first database, and xiii. starting an alternative game if the search for several players results in a match.

8. The method of claim 7, further comprising the steps of:

xiv. proceeding with step i if no players in step xiii matches the search and the time $t_1$ is smaller than a predetermined time limit $t_{final}$.

9. A method for enabling a user to design games and carryout a gaming cycle based on one or more potential random outcomes or one or more outcomes that can be detected on a network, the gaming cycle being for a first user and one or more opponent players on a networked gaming platform or a game application on a computer, and the method comprising the steps of:

a) logging in to the networked gaming platform or starting the game application on the computer, b) selecting or designing a game type by way of the game application or gaming platform, c) choosing, by the first user, a stake and choosing a betting option by the first user, d) directing, by the gaming platform or game application, the first user to a secure payment service if a value corresponding to the stake is not marked as locked in a first database, otherwise, if a value corresponding to the stake is locked, the game application or gaming platform proceeds to step h, e) searching, by the gaming platform or game application, for opponent players having selected the same selected or designed game type, wherein searching for opponent players comprises:

i. entering game parameters into a table and marking the stake as locked, and transferring the table to the first database, ii. sorting, by the gaming platform or game application, players in the first database, with players having chosen the same game, same stake, opposite betting option being sorted by time, iii. searching for an opponent player having same game parameters but an opposite betting option in the first database, and wherein the method further comprises:

iv. if a player matches the search of step iii, proceeding with step f, v. if no player in step iv matches the search, proceeding with step vi, vi. searching, by the gaming platform or game application, for opponent players having selected the same game and an opposite betting option, where the sum of the stakes of the sought players corresponds to the stake of the first user, the search being performed starting with players having a smallest time in the first database, and vii. if the search for multiple players results in a match, proceeding with step f, f) authenticating, by the first user, for the payment service, g) debiting the first user for the stake by the payment platform, h) directing the first user back to the gaming platform or game application, i) starting the selected or designed game from the game application or gaming platform, and j) transferring the game winnings to the winner, k) communicating, via an interface of the game platform or game application, with electronically detectable events on the network.

* * * * *